United States Patent [19]

Marple

[11] 4,268,925

[45] May 26, 1981

[54] SEWAGE TREATMENT SYSTEM

[75] Inventor: Elwood Marple, Tampa, Fla.

[73] Assignee: W. L. Burke, Inc., Brandon, Fla.

[21] Appl. No.: 109,202

[22] Filed: Jan. 3, 1980

Related U.S. Application Data

[63] Continuation of Ser. No. 22,860, Mar. 22, 1979, abandoned.

[51] Int. Cl.[3] ..... A47K 11/02

[52] U.S. Cl. ..... 4/449; 4/DIG. 12; 4/459; 4/111.6; 210/199

[58] Field of Search ..... 4/DIG. 12, 475, 449, 4/476, 462, 459–460, 111.1–111.2, 111.6, 321, 322; 210/199, 201, 218, 539, 14

[56] References Cited

U.S. PATENT DOCUMENTS

| | | | |
|---|---|---|---|
| 3,136,608 | 6/1964 | Lindström | 4/475 |
| 3,523,012 | 8/1970 | Pierson | 4/DIG. 12 |
| 3,624,665 | 11/1971 | Klinger, Sr. | 4/459 |
| 3,776,383 | 12/1973 | Hargraves | 4/DIG. 12 |
| 3,840,907 | 10/1974 | Sundberg | 4/475 |
| 3,859,672 | 1/1975 | Modig | 4/476 X |
| 3,918,106 | 11/1975 | Hallquist | 4/476 X |

*Primary Examiner*—Henry K. Artis
*Attorney, Agent, or Firm*—Stein & Frijouf

[57] ABSTRACT

A self-contained, closed system, aerobic sewage treatment system designed for use in a house or in mobile situations such as a boat, plane, bus, train, etc. comprising a housing with a toilet and a main digestion tank and a series of secondary digestion tanks below the toilet. An air diffusor, an aeration deflector and a quiescent zone are disposed in the majority of the digestive tanks to promote the rapid digestion of the organic waste deposited therein. The final digestion tank which receives the substantially organically pure water from the system has a pump to recirculate some of the water to rinse the toilet bowl after use.

12 Claims, 16 Drawing Figures

SEWAGE TREATMENT SYSTEM

This is a continuation of application Ser. No. 022,860, filed Mar. 22, 1979, now abandoned.

BACKGROUND OF THE INVENTION

This invention relates to aerobic sewage treatment systems. More particularly, this invention relates to self-contained, closed system, aerobic sewage treatment systems having an interconnected series of aerated tanks which progressively purify the waste to essentially organic-free water.

The process of biochemical aerobic digestion of organic waste such as raw sewage is well known. Basically the process consists of aerating raw sewage in an aeration tank. The aeration promotes the growth of microorganisms which feed on and hence digest the raw sewage. Digestion converts the raw sewage primarily into carbon dioxide and water along with sludge. The resultant water-sludge mixture is drawn off into a settling tank. After settling, the sludge is decanted. A small portion of the sludge, as a supernatant, is returned to the aeration tank to innoculate the incoming raw sewage with microorganisms and stimulate rapid synthesis of additional microorganisms. The balance of the supernatant sludge-supernatant is discharged from the system, usually after chlorination.

Problems associated with such sewage treatment systems include the buildup of sludge in the settling tank and the discharge of impure effluent into the environment.

As claimed in U.S. Pat. No. 3,990,967 (Hargraves), substantially complete digestion of organic waste by biochemical action without the production of excessive sludge can be obtained by a progressive biochemical treatment carried out in a series of aerated sewage treatment tanks. Bascially the treatment involves the retention of the large organic solids, both floating and nonfloating, in a first treatment or main digestion tank. After vigorous aeration and substantial digestion, the effluent is passed sequentially through a series of secondary treatment tanks where further settling and biochemical purification takes place. Eventually, substantially waste-free liquid is supposedly obtained in the final tank.

Since biochemical digestion is enhanced by vigorous aeration and turbulent movement of the solids and liquid, the Hargraves patent teaches the use of an air diffusor disposed at the bottom of each tank. Air is forced out of the air diffusor so as to cause a rolling motion of the liquid-solid mixture. The rolling motion is claimed to have the favorable effect of: (1) supplying oxygen directly to the microorganisms; (2) moving the microorganisms to the surface of the liquid-solid mixture within the tank to thereby expose the microorganisms to the air above the mixture; and (3) breaking up the solids into smaller and smaller particles as they roll around in each tank.

Unfortunately, in actual practice the Hargraves effects are not attained to the degree necessary for adequate digestion. This inability is most acute in the main digestion tank where break up and aeration of the solids is essential for the effective operation of the entire system. Inadequate digestion of the solids in the main digestive tank will unduly pollute the secondary tanks. The process of having progressively purer secondary stages is, therefore, defeated.

The Hargraves patent attempts to adequately break up and aerate the solids in the main digestion tank by locating the air diffusor below a screen (see FIG. 2). Air flowing out of the diffusor aerates and agitates the solids as they settle on the screen. In practice, clogging of the screen and inadequate aeration of the settled solids not directly above the diffusor occurs.

The Hargraves patent also incorporates an air lift within the main digestion tank (see FIG. 10). Here, the solids are air lifted up a bent conduit and are then forcibly discharged against a wall member to break up the solids. In practice, the air bubbles are unable to air lift large solids up the conduit. Such large solids then clog the conduit.

Another problem, as noted earlier, is retention of the larger solids in the main digestion tank. Only smaller solids should be passed on to subsequent digestion tanks. To insure such, the Hargraves patent (FIG. 2) shows a conduit disposed within each digestion tank. The submerged opening of the conduit is covered with a filter. The filter prevents suspended large solids from flowing up the conduit and into the subsequent digestion tank. Unfortunately as can be expected with all filters, the clogging which eventually occurs necessitates the removal and cleaning of the filter. This problem is most acute in the main digestion tank where the larger solids are encountered.

The Hargraves patent also uses quiescent chambers in each tank to prevent larger solids from flowing into subsequent stages (see FIGS. 8 and 9). A horizontal conduit connected to a vertical conduit are disposed within each digestion tank. The liquid in the vertical conduit is substantially stagnant, thereby facilitating the settling of larger solids contained therein to the bottom of the digestion tank where they are then drawn away by the rolling motion of the liquid in that tank. Such a quiescent chamber has several drawbacks including: (1) the unstreamlined configuration of the quiescent chamber disrupts the rolling motion of the liquid contained in that digestion tank; (2) the submerged opening of the quiescent chamber is of such large diameter that the rolling motion of the liquid in that digestion tank agitates the liquid contained in the quiescent chamber; and (3) undue tilting of the digestion tank causes flooding of the subsequent stage.

Therefore an object of this invention is to provide a sewage treatment system which uniquely avoids sludge buildup.

Another object is to provide a self-contained sewage treatment system thereby precluding the need to discharge effluent into the environment.

Still another object is to provide a means to progressively biochemically treat raw sewage.

A further object is to provide a novel means to vigorously aerate the solids suspended in the liquid of each digestion tank in a sewage treatment system.

A still further object of this invention is to provide means to insure that only the smaller particles suspended in the liquid in a preceding digestion tank are passed on to the subsequent digestion tank.

Another object is to provide means to insure that the raw sewage is vigorously aerated in the main digestion tank without requiring screens or filters which may become clogged.

Another object is to provide means to break-up the solids contained in the main digestion tank and other secondary digestion tanks.

Another object is to provide streamlined quiescent chambers which do not interfere with the rolling motion of the liquid in each digestion tank.

Another object is to provide means to insure that the rolling motion of the liquid in each digestion tank does not agitate the stagnant liquid contained in the quiescent chamber.

Another object is to provide means to help prevent flooding of a subsequent digestion stage should the sewage treatment system be utilized in a rocking or otherwise unstable environment.

Another object is to provide means for the sewage digestive system to be incorporated into a portable, self-contained toilet facility which may be used in a large variety of situations such as on a boat, plane, mobile home, etc.

Other objects of the invention will in part be obvious and will in part appear hereinafter.

SUMMARY OF THE INVENTION

A unique configuration for a sewage treatment system which is truly completely self-contained has now been devised. No sludge or effluent need be discharged from the system. The invention is basically a toilet comprising a series of highly aerated digestion tanks. The first sewage treatment tank, or main digestion tank, comprises two compartments separated by a weir. The floors of each compartment are sloped downwardly toward the weir. An air diffusor supplied by an air line is disposed in the corner of each compartment at the apex of the weir and each sloped floor. As raw sewage is deposited in the first compartment, it is aerated in a rolling motion. The sewage then overflows into the second compartment where the waste is further aerated and digested with a similar but opposite rolling motion. All large floating solids are retained in these compartments during digestion. After being broken up by the vigorous aeration in both of the chambers, the solids are passed to the successive digestion tanks.

A unique quiescent chamber specially designed for use in the main digestion tank prevents larger solids from overflowing into the secondary digestion tanks.

An aerator is disposed along the bottom of each secondary tank to aerate and hence promote the digestion of the suspended solids. A variety of quiescent chambers, sloped floors and aerator deflectors further promote digestion.

Each secondary digestion tank progressively digests the suspended solids until essentially organic-free water is obtained in the final digestion tank. The organic-free water contained therein may then be pumped to the original main digestion tank to rinse the same after use, or it may be discarded into the environment after chlorination.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts through the several views of the drawings.

DETAILED DESCRIPTION

Figure 4:
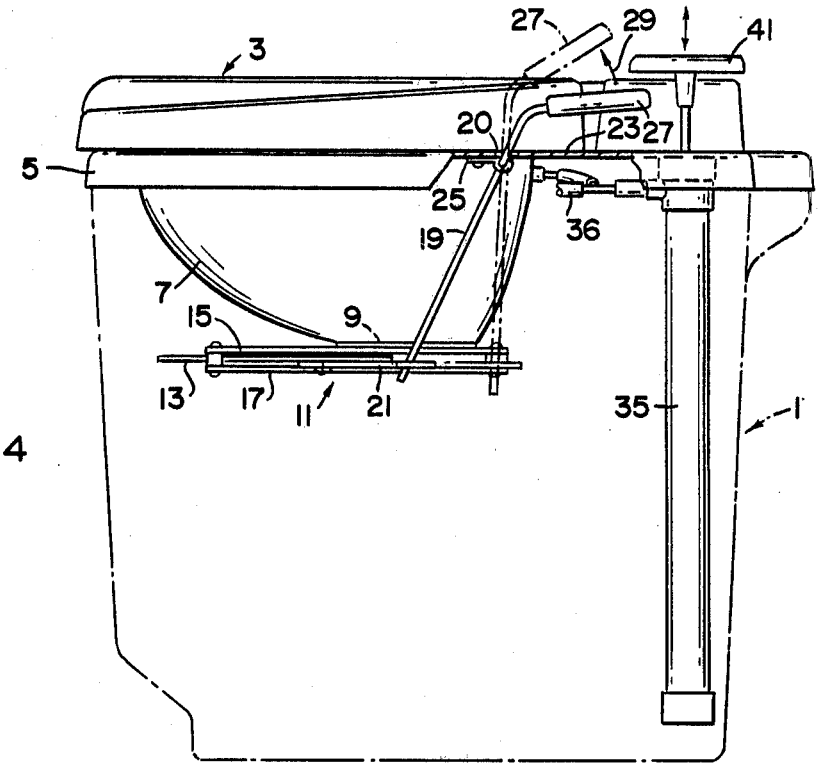
FIG. 4 is a side view of the shutter mechanism disposed across the lower bowl opening.
Figure 5:
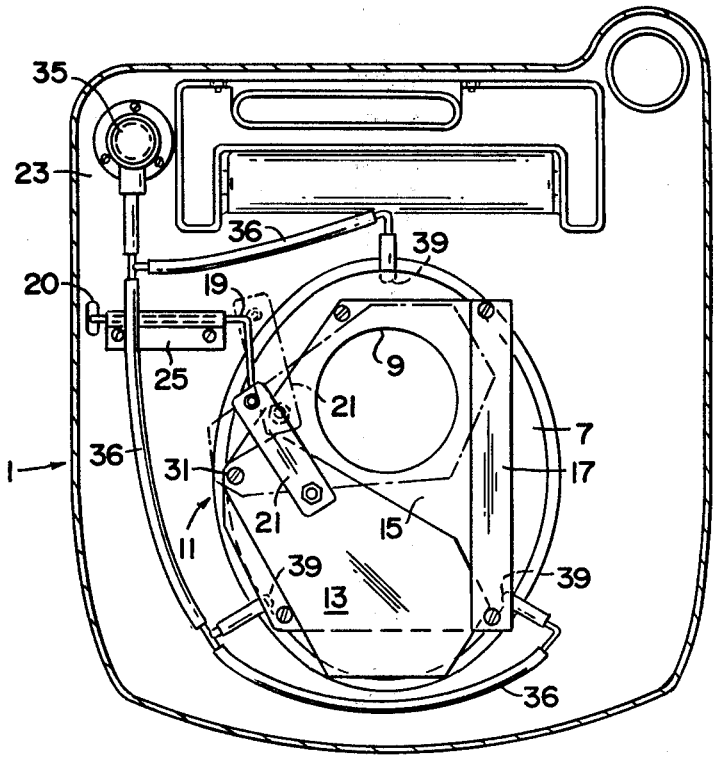
FIG. 5 is a bottom view of the shutter mechanism.

The sewage treatment system of this invention comprises a facility 1 with a lid 3. Lid 3 has a protrusion 4, which will be described hereinafter in greater detail. Beneath the lid 3 is a hinged seat 5. A bowl 7 with a lower bowl opening 9 leads into the first chamber 47 of the main digestion tank 48. As will be seen from FIGS. 4 and 5, there is a shutter mechanism 11 operates to cover lower bowl opening 9. The shutter mechanism 11 has shutter 13 which pivots horizontally about shutter pivot 31 between upper shutter plate 15 and lower shutter plate 17. The pivoting movement of shutter 13 is accomplished by a shutter actuator lever 19. The lower end of lever 19 extends into shutter actuator arm 21 which is pivotably connected to shutter 13. Lever 19 is pivotably contained within a shutter hinge bracket 25. The upper end of the lever 19 extends through a hole 20 and terminates as a shutter handle 27. When handle 27 is pulled upwardly, as shown by arrow 29 (FIG. 4), lever 19 pivots within hinge bracket 25 to pull actuator arm 21. Such action causes the shutter 13 to pivot counterclockwise about shutter pivot 31 and to slide into a closed position (as shown in phantom in FIG. 5). Movement of shutter 13 into an open position is accomplished by a downward push movement on handle 27.

A rinsing mechanism incorporated into the toilet comprises a lift pump 35 with pump operating handle 41 extending through the upper wall 23 of the toilet. The lower end of the pump 35 extends into the last stage of the sewage treatment system. Hoses 36 in fluid communication with jets 39 disposed about the interior periphery of the bowl 7 directs the lifted water from the pump 35 to the jets 39. Preferably, the jets 39 are disposed uniformly around the interior of the bowl 7.

Figure 1:
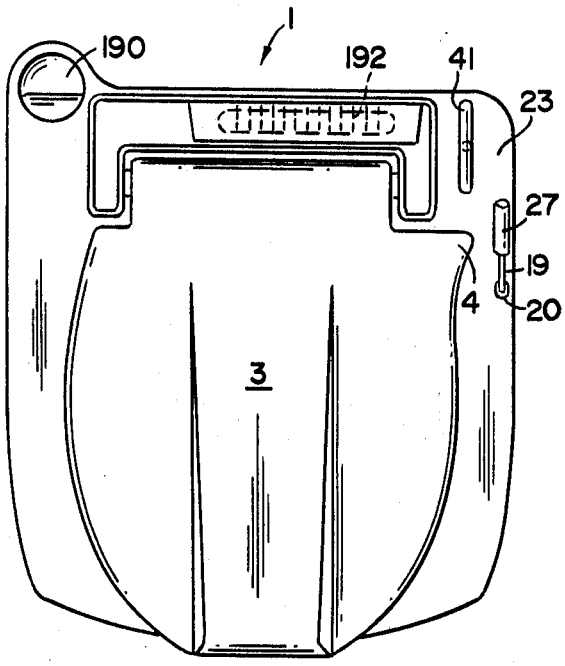
FIG. 1 is a top view of the toilet of this invention.
Figure 2:
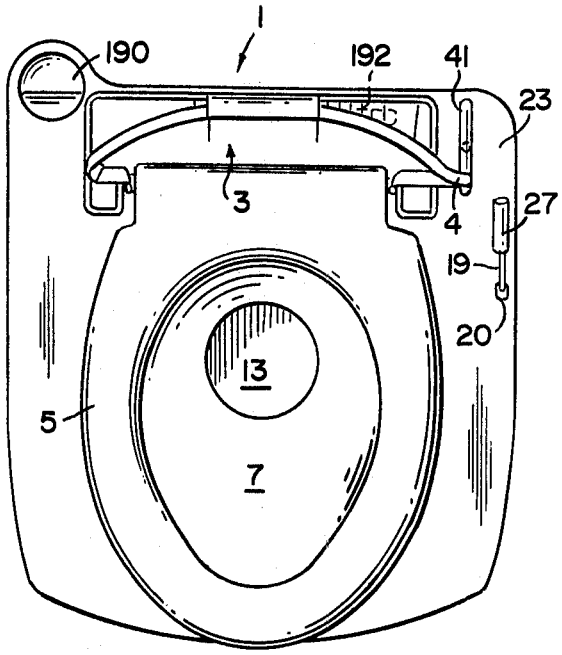
FIG. 2 is another top view of the toilet with the toilet lid in an open position.
Figure 3:
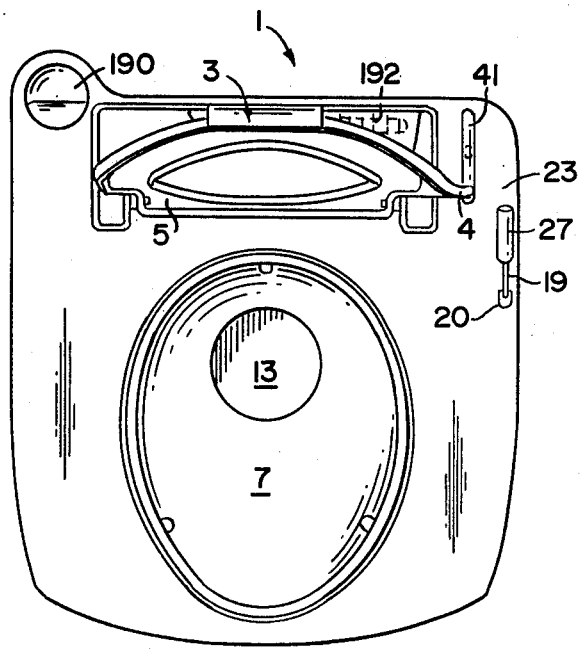
FIG. 3 is still another top view of the toilet with the toilet lid and the toilet seat in an open position.

Since the toilet facility 1 may be used on a boat, the use of the invention should conform to United States Coast Guard regulations. These regulations require that the lift pump 35 be rendered inoperable while the user is seated on seat 5. To enable such conformance, as best shown in FIGS. 1 and 2, a protrusion 4 has been incorporated into the lid 3. When lid 3 is in a raised position, the protrusion 4 is disposed immediately above the handle 41 of the pump 35, thereby rendering the pump 35 inoperable. Variations such as a clip means or a hook means (not shown) may also be utilized to render the pump inoperable.

Progressive biochemical treatment of organic waste has been briefly discussed above. Such progressive biochemical treatment is utilized in this invention but with several improvements.

Figure 6:
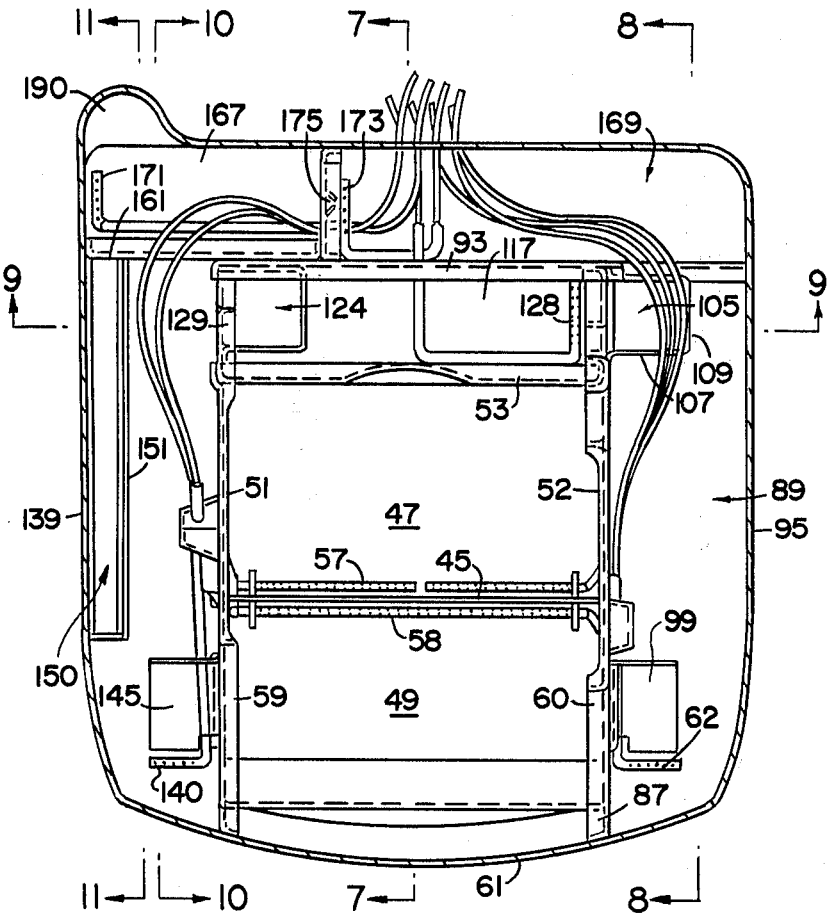
FIG. 6 is a top view of the interior of the toilet with the lid, seat and cover removed.

As seen in FIG. 6, the toilet facility 1 basically has a series of aerated sewage treatment tanks arranged progressively around the main digestion tank 48. Tank 48 is divided by a weir 45 into a first chamber 47 and a second chamber 49. The first chamber 47 is formed by sidewalls 51 and 52, a back wall 53, weir 45 and a sloped floor 55 (see FIG. 7). The sloped floor 55 is downwardly sloped toward the weir 45. An air diffusor 57 is disposed along the inside corner formed by the sloped floor 55 and the weir 45.

In similar fashion, the second chamber 49 is formed by sidewalls 59 and 60, front toilet wall 61, weir 45 and a sloped floor 63. The sloped floor 63 is downwardly sloped toward the weir 45. Air diffusor 58 is disposed along the corner formed by the sloped floor 63 and the weir 45.

In the first chamber 47, the air emitted from the diffusor 57 travels upwardly, then horizontally, then downwardly, and then along the direction of the sloped floor 55 as shown by arrow 65. Such travel creates a continuous rolling clockwise movement within first chamber 47.

Similarly, in the second chamber 49, the air emitted from the air diffusor 58 travels upwardly, then horizontally, then downwardly and then along the direction of the sloped floor 63 as shown by arrow 67. Such travel creates a continuous rolling counterclockwise movement within second chamber 49. An air diffusor baffle or deflector 69 is incorporated into second chamber 49 to further define the rolling action.

One important feature of the rolling action, as indicated above, is that it breaks up the solids as they are rolled about in each chamber 47 and 49. Additionally, the rolling action insures full aeration of the solids to promote rapid digestion. The rolling action also exposes the solids to surface air where the solids are further aerated. When considered in conjunction with the sloped floors 55 and 63, the rolling action substantially prevents settling of any solids on the sloped floors 55 and 63. Any solids that nevertheless do settle, will slide down the sloped floors 55 and 63 where bubbles emitted from the air diffusors 57 and 58 breaks up and aerates the solids.

Two important improvements have been incorporated into the main digestive tank 48 of this invention. One improvement comprises a higher velocity for the rolling motion in chamber 47 as compared to the velocity in chamber 49. The second improvement is that the rolling motion in chamber 47 is opposite in direction to that of chamber 49. These two forces uniquely coact to create a filtering effect; namely, larger solids are retained in chamber 47 while smaller solids spill over into chamber 49. Further, should new waste be introduced via bowl opening 9 and land on the top edge 70 of the weir 45 (see FIG. 7), the faster rolling motion of first chamber 47 will drag such waste into chamber 47 where the larger solids are being digested.

Figure 7:
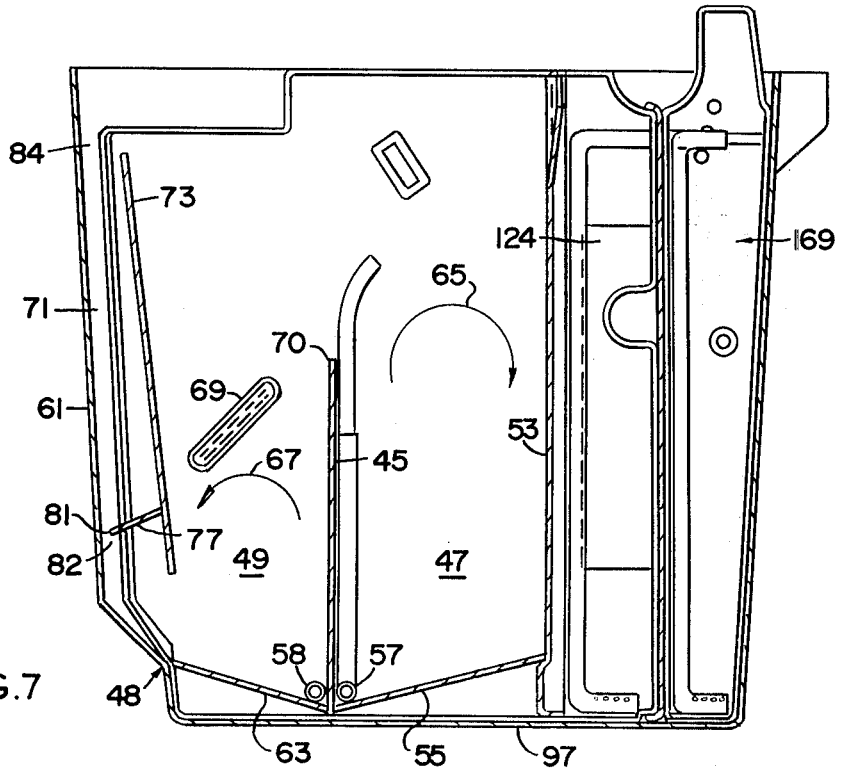
FIG. 7 is a cross-sectional view taken along lines 7—7 of FIG. 6 to more adequately show the main digestion tank in the toilet.

Immediately forward of chamber 49 is a quiescent zone 71. This quiescent zone 71 comprises vertically angular quiescent wall 73 and horizontal angular flange 77. The edge 81 of flange 77 is spaced from the front toilet wall 61. As best illustrated in FIG. 7, the area of the bottom opening 82 is less than the area of the top opening 84 of the quiescent chamber 71. Such spatial arrangement is particularly advantageous when an unstable or rough condition, such as on a boat or camper, is encountered. The smaller area of the bottom opening 82 prevents rapid flooding of the quiescent chamber 71 thereby maintaining the stagnant condition in that chamber 71. At the same time, the spatial arrangement precludes rapid flooding of the next digestion tank.

The positioning of flange 77 in an angled position also facilitates settling and removal of any excessively large solids that may have entered quiescent chamber 71. After settling, such solids sink toward opening 82 along angled flange 77. The solids then slide off the flange 77 and are gently redeposited into chamber 49 and recirculated in the main digestive tank 48 for further digestion.

The smaller suspended solids and the effluent in the quiescent zone 71 then flows through overflow opening 87 (see FIGS. 6 and 8) into a second digestion tank 89.

Figure 8:
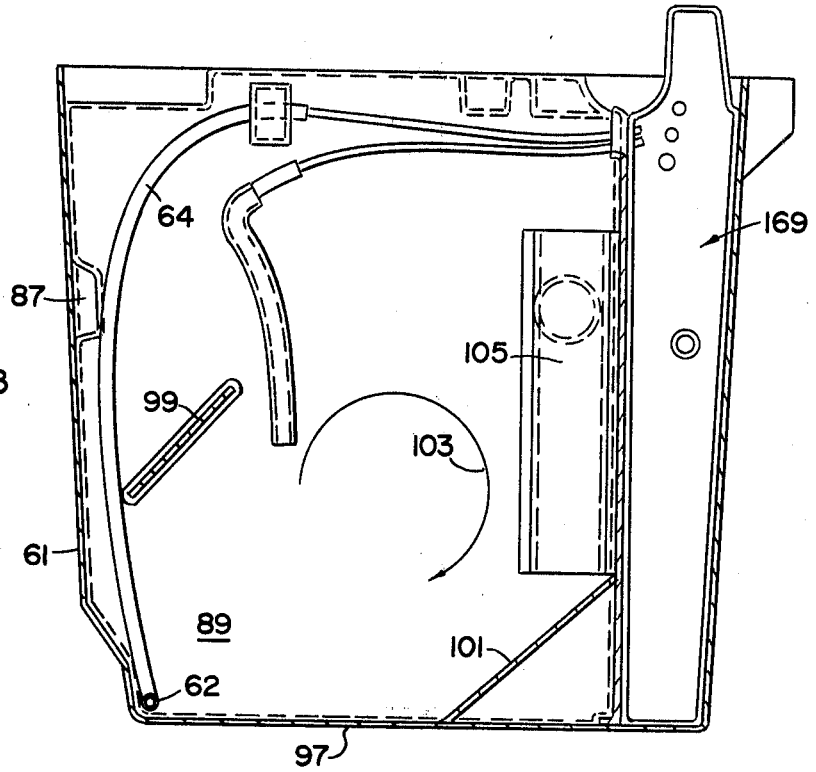
FIG. 8 is a cross-sectional view taken along lines 8—8 of FIG. 6 to more adequately show the second digestion tank.

Second digestion tank 89 comprises the right (as one faces the toilet) portion of wall 61, walls 52 and 60, an outer portion of intermediate wall 93 (FIG. 6), the right wall 95 of toilet 1, and floor 97 (FIG. 8). An air diffusor 62 to which air is supplied via air line 64 is disposed along the corner formed by the front wall 61 and the floor 97. An aeration deflector 99 is located above air diffusor 60. Disposed in the corner formed by the floor 97 and the intermediate wall 93 is a sloped floor member 101. The aeration deflector 99 and the sloped floor member 101 work in concert to direct the air bubbles emitted from diffusor 62 in a continuous clockwise rolling motion, as shown by arrow 103. Such an aerating, rolling motion promotes further rapid digestion of the smaller suspended solids deposited from quiescent zone 71 into the second digestion tank 89.

Figure 9:
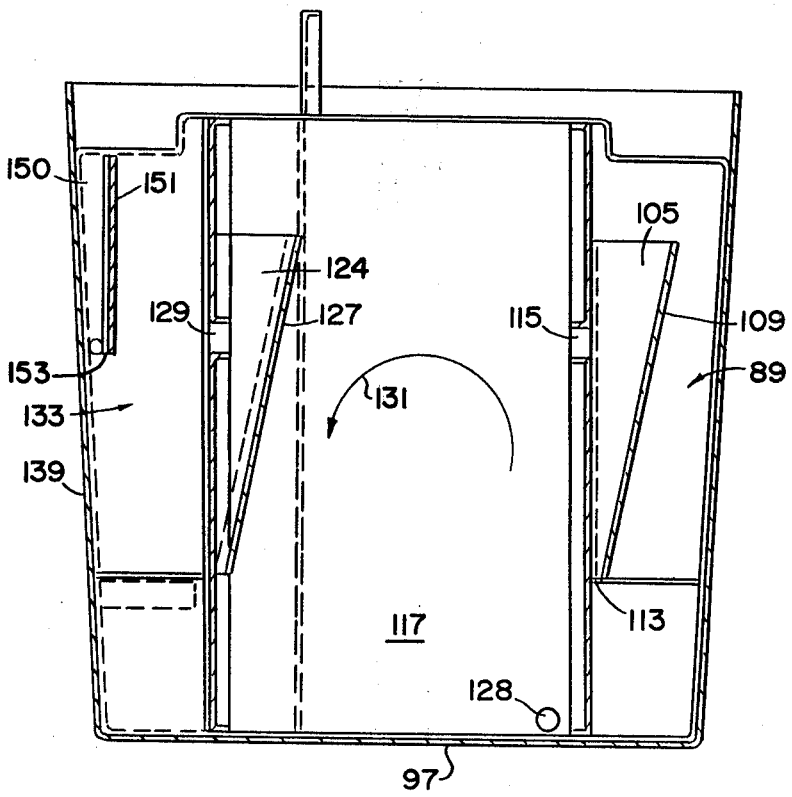
FIG. 9 is a cross-sectional view taken along lines 9—9 of FIG. 6 to more adequately show the third digestion tank.
Figure 10:
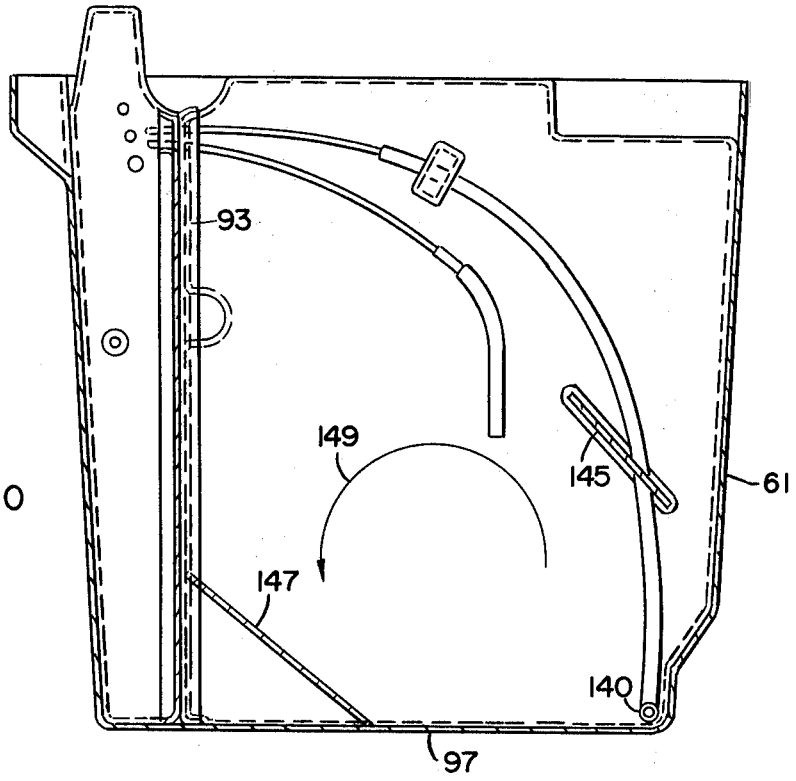
FIG. 10 is a cross-sectional view taken along lines 10—10 of FIG. 6 to more adequately show the fourth digestion tank.
Figure 11:
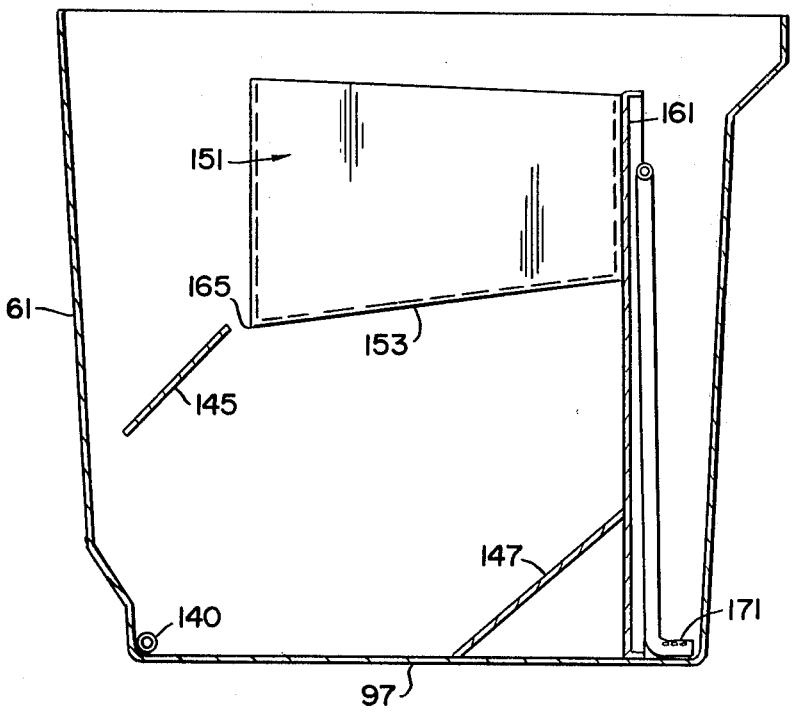
FIG. 11 is another cross-sectional view of the fourth digestion tank but taken along lines 11—11 of FIG. 6 to more adequately show the shape of the quiescent chamber.

Quiescent zone 105 comprising a downwardly sloped wall 107 and sidewall 109 is located in the rear portion of second digestion tank 89. As seen from the cross-sectional view of FIG. 9, quiescent zone 105 has an inverted cone-shape with the apex open for fluid communication with the main body of liquid in second digestion tank 89. The liquid (and suspended solids) in quiescent chamber 105 is substantially stagnant thereby enabling settling of any larger suspended solids. As such solids settle, they sink out opening 113 and are swept up by the rolling motion of the liquid contained in the second digestion tank 89 for further aeration.

It is to be noted that the sloped wall 107 minimizes disruption of the rolling motion in the second digestion tank 89. This sloped wall 107 may be shaped in concave fashion thereby further enabling minimum disruption of the rolling motion.

An important feature of the shape of quiescent chamber 105 is that it prevents rapid flooding when there is a sudden tilting of the toilet. The third digestion tank 117 is thereby protected against sudden surges.

The liquid (and the now suspended solids) in second digestion tank 89 flows out second digestion tank overflow opening 115 into the third digestion tank 117.

The third digestion tank 117 (FIGS. 6, 7 & 9) comprises backwall 53 of first chamber 47, a part of first chamber wall 51, a part of intermediate wall 93, a part of first chamber wall 52 and a part of floor 97.

To retain the larger particles while passing the smaller particles to the fourth digestion tank 133, a third quiescent zone 124, identical to second quiescent zone 105, is disposed along wall 51 about an overflow opening 129.

Operation of the third digestion tank 117 is similar to the operation of the second digestion tank 89. The rolling motion created by the air diffusor 128 and the sloped wall 127 working in concert as shown by arrow 131 (FIG. 9) promotes the digestion of the suspended solids. It is to be noted that an aeration deflector may be disposed above the air diffusor 128 should it be necessary to further define the rolling motion of the liquid.

The fourth digestion tank 133 (see FIGS. 6, 9, 10 and 11) comprises a part of front wall 61, most of left toilet sidewall 139, a part of intermediate wall 93, intermediate walls 51 and 59 and floor 97. Air diffusor 140, aeration deflector 145 and sloped floor member 147 effect a rolling motion identical to that in second digestion tank 89 (arrow 149).

A fourth quiescent zone 150 disposed in the fourth digestion tank 133 comprises a vertical wall 151, a slanted bottom wall 153, left toilet sidewall 139 and a back wall comprising a part of intermediate wall 93. Fourth overflow opening 161 leads into the fifth digestion tank 167.

A desirable feature of the fourth quiescent zone 150 is that if the toilet facility 1 is used in a rocking environment, such as on a boat, and if the toilet facility 1 is tilted backwardly, the lower front edge 165, which is normally below the water line of the fourth digestion tank 133 is tilted above the water line thereby preventing flooding of the fifth digestion tank 167 via the overflow opening 161.

As best seen in FIG. 6, the final two stages of the system of this invention comprises a fifth digestion tank 167 and a sixth digestion tank 169. Both tanks 167 and 169 have a substantially rectangular configuration. Air diffusors 171 and 173 are respectively disposed at the bottom of each tank 167 and 169.

It should be noted that liquid in the fourth digestion tank 150 has at this stage in digestion, been essentially cleaned of organic waste. Hence, the purpose of these final two stages (fifth and sixth digestion tanks) is to assure thorough elimination of solids.

Liquid in the fifth tank 167 overflows through fifth overflow opening 175 into the sixth tank 169. Liquid from the sixth tank 169 may be pumped by water pump 35 to rinse the toilet bowl 7 after use, or discarded into the environment.

Figure 12:
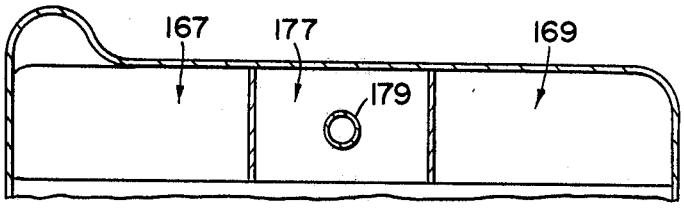
FIG. 12 is a partial top view of another embodiment of the invention having a final digestion tank, a chlorination tank and a predisposal aeration tank.
Figure 13:
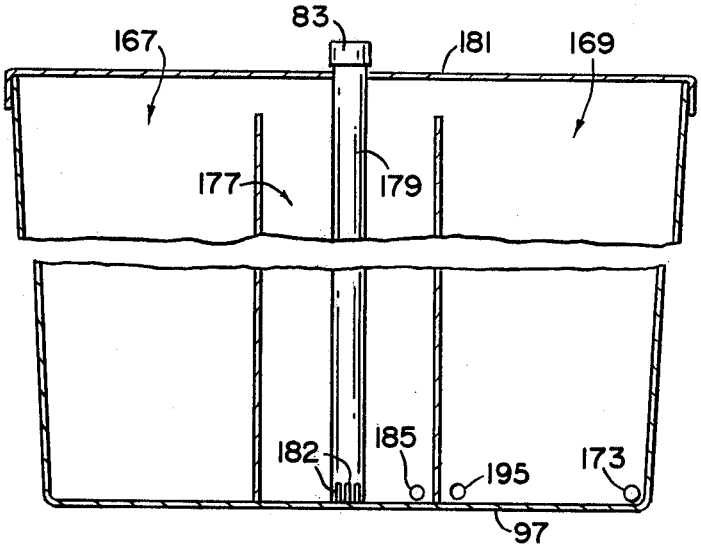
FIG. 13 is a cross-sectional view of the tanks of FIG. 12.

A chlorination tank 177 may be interposed between the fourth and fifth digestion tank 167 and 169 (see FIGS. 12 and 13). Such a chlorination tank 177 includes a vertically disposed tube 179 extending through the upper rear top 181 of the toilet. Aperture means such as slots 182 are disposed on the bottom of tube 179 to facilitate dissolution of tablets dropped in the tube. A cap 183 covers the upper end of the tube 179. A chlorination tablet may thereby be dropped into tube 179. As the tablet dissolves, the chlorine is dispersed thereby to chlorinate the liquid in tank 177. An air diffusor 185 may be disposed at the bottom of the chlorination tank 177 to assist in dispersing the chlorine and in venting it to the atmosphere within the toilet facility 1. Chlorination tank overflow opening enables overflow of the chlorinated liquid into sixth digestion tank 169 which now acts as a predisposal aeration tank. Here, the liquid is further aerated by air diffuser 173 to give pure water. The water may be reused, via pump 35 or discarded into the environment via drain 195 which may connect to the sump pump of the vessel upon which the toilet facility is used.

Figure 16:
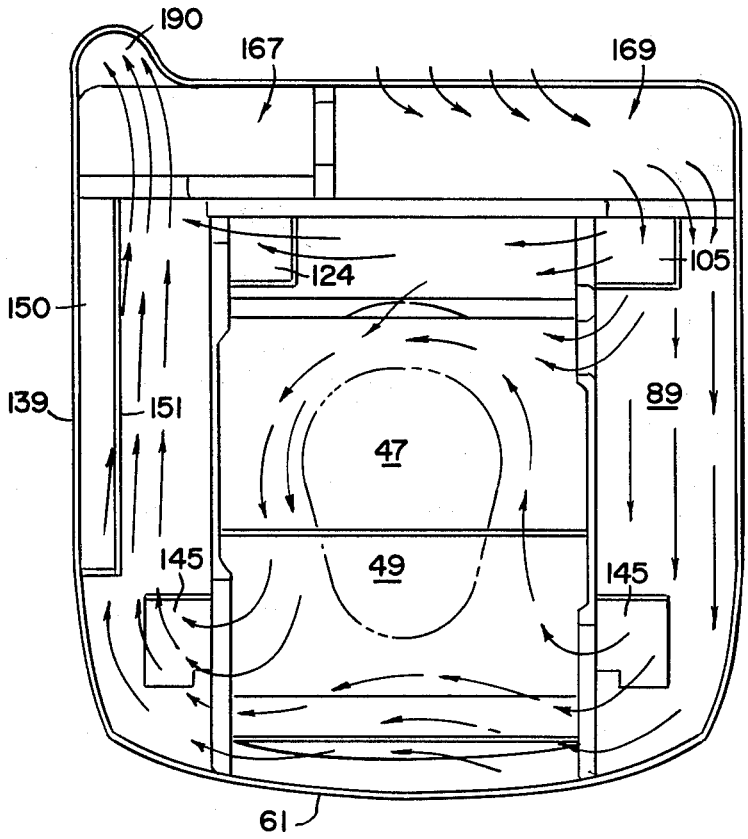
FIG. 16 is a ventilation air flow diagram.

FIG. 16 shows the flow of ventilation over the surfaces of each successive digestion tank and then out the ventilation stack 190. Stack 190 may be connected to an exhaust fan (not shown) to totally eliminate odor from the toilet facility 1. It is to be noted that in normal operation any natural evaporation of liquid caused by such venting can be compensated for by adding pure water through slots 192 at the rear of the toilet.

Figure 14:
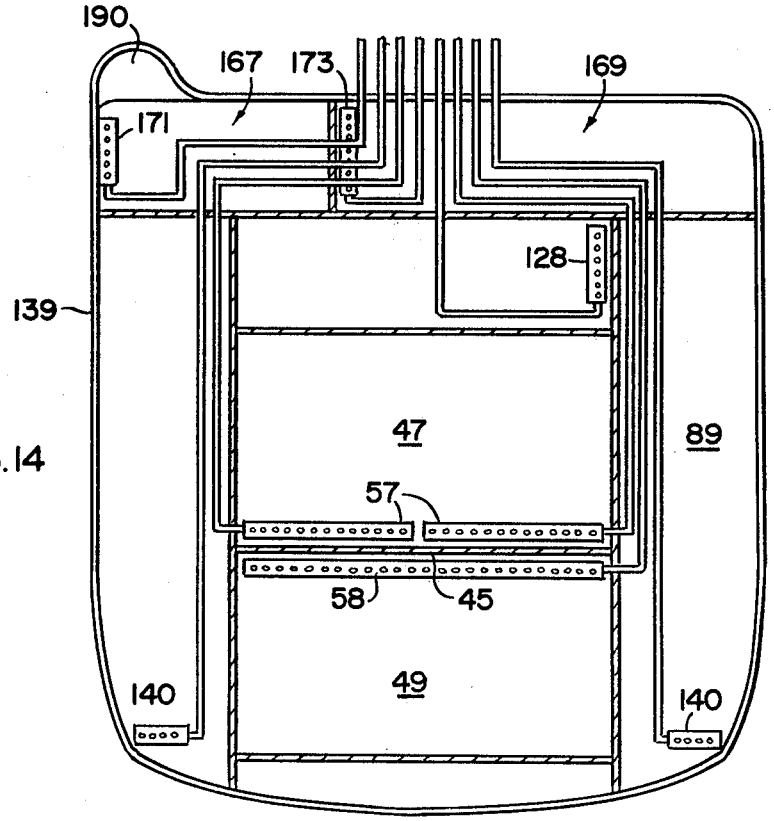
FIG. 14 is an aeration diagram showing schematically the location of the air diffusors.

FIG. 14 schematically illustrates the disposition of the various air diffusors and air lines leading thereto. An eight unit pump module or other suitable pump may be used as the air supply.

Figure 15:
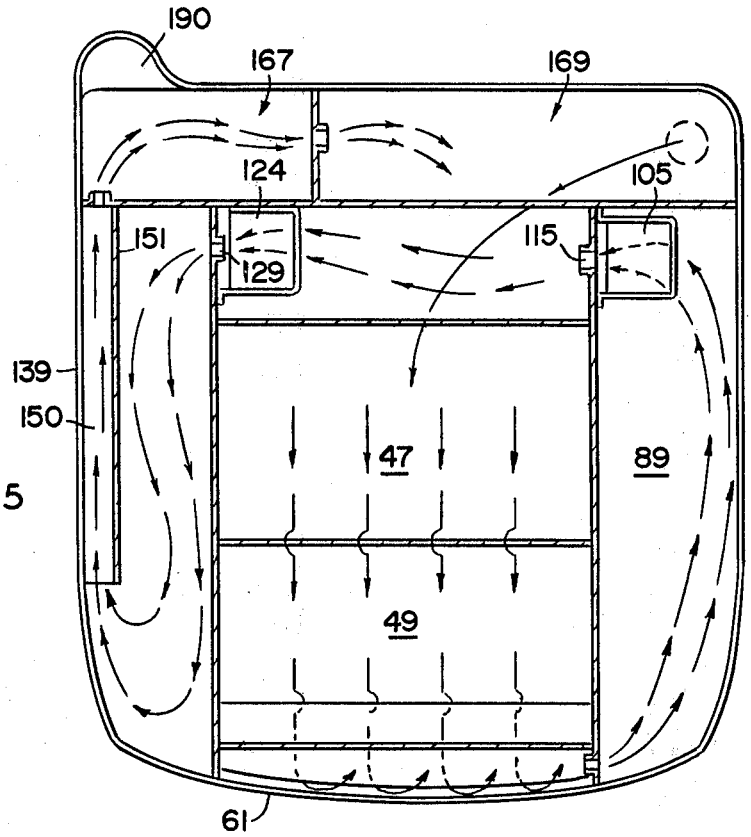
FIG. 15 is a fluid flow diagram.

FIG. 15 shows the fluid flow of liquid and suspended solids as they sequentially traverse the several digestion tanks or stages.

It should be evident from the above specification that the objectives enumerated above and others are accomplished by the self-contained, closed system, aerobic sewage treatment system of this invention. Sewage deposited in the bowl drops into the main digestion tank where it is vigorously agitated and broken down in the first chamber just below the bowl opening. With this invention, the larger solids are now preferably retained in the chamber where the greatest degree of aerated rolling action is occurring. The liquid portion of the waste and smaller solids drift into the second chamber over the weir. Then the unique configuration of the quiescent zone of the main digestion tank performs a good separation of the small solids and liquid from the larger solids. The latter are recirculated for further digestion.

The smaller solids and the liquid then pass on to the successive digestion tanks for further aeration until pure water is obtained. In these secondary tanks, the continued rolling motion, the shape of the tank, the use of an aeration deflector and the shape of the quiescent zone all contribute to attainment of pure water in the last stage. Now a truly self-contained, closed system, aerobic sewage treatment system has been accomplished.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

What is claimed is:

1. A biochemical sewage treatment system for progressive digestion of organic material disposed in water, comprising in combination:

a main digestive tank for receiving the organic material;

a weir disposed in said main digestive tank dividing said main digestive tank into a first chamber and a second chamber;

a first and a second air diffusor respectively disposed in said first chamber and said second chamber for aeration of the organic material;

the floors of said first chamber and said second chamber sloped downwardly toward said weir;

a series of secondary digestion tanks serially disposed in fluid communication with said main digestive tank to progressively digest the organic material;

an air diffusor disposed in one of said secondary digestion tanks to aerate the organic material;

a final digestion tank disposed in fluid communication with the last said secondary digestion tank for storing the essentially organic-free water.

2. The biochemical sewage treatment system of claim 1, wherein said first and said second air diffusors are respectively disposed in the corners formed by the floors of said first and said second chambers and said weir to create a rolling motion of the organic material and the water in said first and said second chambers when air is emitted from said first and said second air diffusors.

3. The biochemical sewage treatment system of claim 1, including means for supplying more air to said first air diffusor than to said second air diffusor to create a faster rolling motion in said first chamber than in said second chamber.

4. The biochemical sewage treatment system of claim 1, wherein a third air diffusor is disposed in said first chamber to create a faster rolling motion in said first chamber than in said second chamber.

5. The biochemical sewage treatment system of claim 1, further comprising a chlorination tank disposed between the last of said secondary digestion tank and said final digestion tanks.

6. A biochemical sewage treatment system for progressive digestion of organic material, comprising in combination:

a main digestive tank for receiving the organic material;

a series of secondary digestion tanks serially disposed in fluid communication with said main digestive tank to progressively digest the organic material;

a final digestion tank disposed in fluid communication with the last said secondary digestion tank for storing the essentially organic-free water;

a quiescent chamber disposed in said main digestive tank;

said quiescent chamber comprising a vertically angular quiescent wall in a tilted spaced relationship to a wall of said main digestive tank;

said quiescent chamber further comprising a downwardly sloped flange contiguous to said quiescent wall;

an edge of said flange being spaced from said wall of said main digestive tank to create a bottom opening in said quiescent chamber;

an overflow opening disposed in said quiescent chamber leading to said series of secondary digestive tanks; and an air diffusor disposed in one of said secondary digestive tanks to aerate the organic material.

7. A biochemical sewage treatment system for progressive digestion of organic material disposed in water, comprising in combination:

a main digestive tank for receiving the organic material;

a series of secondary digestive tanks serially disposed in fluid communication with said main digestive tank to progressively digest the organic material;

a final digestion tank disposed in fluid communication with the last said secondary digestion tank for storing the essentially organic free water;

an air diffusor disposed in one of said secondary digestion tanks to aerate the organic material;

a quiescent chamber disposed in one of said secondary digestion tanks;

an overflow opening disposed in said quiescent chamber leading into the subsequent secondary digestion tanks;

said quiescent chamber comprising a substantially inverted cone-shape with the apex open for fluid communication with the water and organic material in said secondary digestion tanks.

8. The biochemical sewage treatement system of claim 7, wherein said quiescent chamber further comprises a sloped wall to direct air bubbles flowing from said air diffusor into a rolling motion.

9. The biochemical sewage treatment system as set forth in claim 8, further comprising in combination:

a jet disposed about the interior periphery of said toilet bowl;

a water pump disposed in fluid communication with said jet;

said water pump disposed in said final digestion tank to pump the essentially organic-free water contained in said final digestion tank to said jet to rinse said toilet bowl.

10. A biochemical sewage treatment system for progressive digestion of organic material disposed in water, comprising in combination:

a main digestive tank for receiving the organic material;

a series of secondary digestion tanks serially disposed in fluid communication with said main digestive tank to progressively digest the organic material;

a final digestion tank disposed in fluid communication with the last said secondary digestion tank for storing the essentially organic-free water;

a toilet bowl disposed above said main digestive tank enabling the organic material to be deposited into said main digestive tank through a lower opening of said toilet bowl;

a toilet seat connected relative to said toilet bowl; and a toilet lid disposed relative to said toilet bowl for covering said toilet bowl while the organic material is not being deposited into said main digestive tank.

11. The biochemical sewage treatment system of claim 10, including a shutter mechanism disposed about the lower opening of said toilet bowl and comprising in combination:

an upper shutter plate connected to said toilet bowl;

a lower shutter plate connected relative to said upper shutter plate;

a shutter pivotably disposed between said upper shutter plate and said lower shutter plate;

a shutter actuator lever pivotably connected to said shutter to move said shutter between an open position and a closed position when said shutter actuator lever is actuated.

12. The biochemical sewage treatment system of claim 10, wherein said toilet lid includes a protuberance which extends over the handle of said water pump when said toilet lid is in a raised position thereby rendering said water pump inoperable.

* * * * *